US005951848A

United States Patent [19]

Baker, Jr. et al.

[11] Patent Number: 5,951,848

[45] Date of Patent: Sep. 14, 1999

[54] PROCESS FOR HIGHLY SHAPE SELECTIVE DEWAXING WHICH RETARDS CATALYST AGING

[75] Inventors: Charles L. Baker, Jr., Thornton, Pa.; Richard C. Dougherty, Morrestown, N.J.

[73] Assignee: Mobil Oil Corporation, Fairfax, Va.

[21] Appl. No.: 08/960,207

[22] Filed: Oct. 29, 1997

Related U.S. Application Data

[63] Continuation-in-part of application No. 08/742,639, Oct. 31, 1996, abandoned.

[51] Int. Cl.[6] ..... C10G 65/08

[52] U.S. Cl. ..... 208/28; 208/57; 208/89; 208/97; 208/143

[58] Field of Search ..... 208/28, 57, 89, 208/97, 143

[56] References Cited

U.S. PATENT DOCUMENTS 4,414,097 11/1983 Chester et al. ..... 208/59
4,790,928 12/1988 Chang et al. ..... 208/111
4,810,357 3/1989 Chester et al. ..... 208/78
4,919,788 4/1990 Chen et al. ..... 208/59
5,246,566 9/1993 Miller ..... 208/27
5,275,719 1/1994 Baker, Jr. et al. ..... 208/58

*Primary Examiner*—Bekir L. Yildirim
*Attorney, Agent, or Firm*—Penny L. Prater; Malcolm D. Keen

[57] ABSTRACT

This application discloses a process for catalytically dewaxing a feedstock whereby the aging of the dewaxing catalyst is minimized. A variety of feedstocks which possess moderate levels of nitrogen and sulfur may be dewaxed in this invention. The feed is treated by a catalyst system comprising two catalysts acting in synergistic combination, a hydrotreating catalyst and a dewaxing catalyst. The hydrotreating catalyst is preferably loaded with noble metals and is capable of operating at higher than usual space velocities. The dewaxing catalyst is downstream of the hydrotreating catalyst. The dewaxing catalyst further comprises a constrained intermediate pore crystalline material which is loaded with a noble metal.

15 Claims, 7 Drawing Sheets

HDT / 0.5% Pt/ZSM-23 Catalyst Aging For Dewaxing Hydrocrackates and a Solvent Raffinate

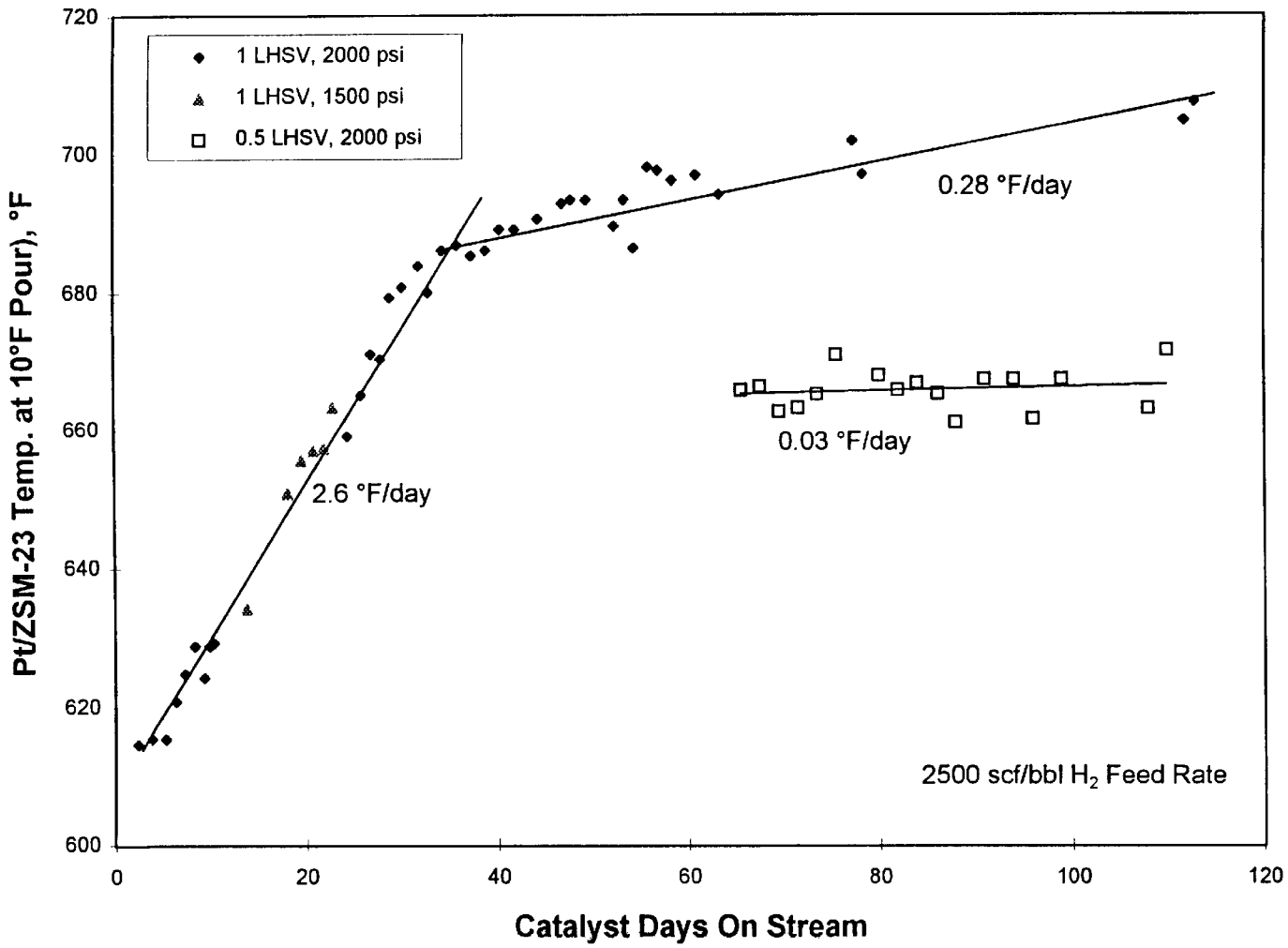
Figure 1: 0.2% Pt/ZSM-23 Catalyst Aging For Dewaxing Hydrocracked Heavy Vacuum Gas Oil (Feed A)

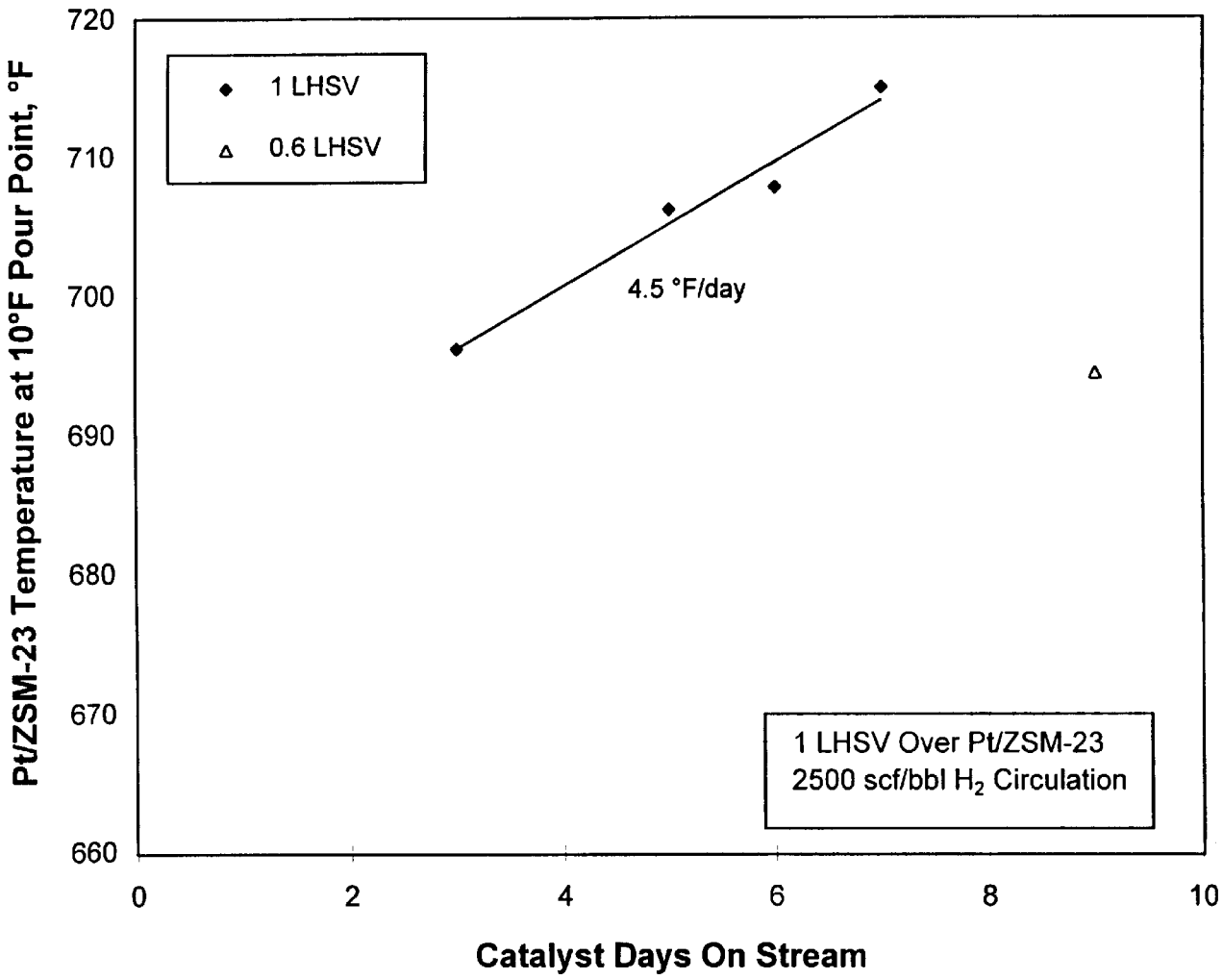
Figure 2: 0.2% Pt/ZSM-23 Catalyst Aging For Dewaxing Contaminated Hydrocracked Heavy Vacuum Gas Oil (Feed B)

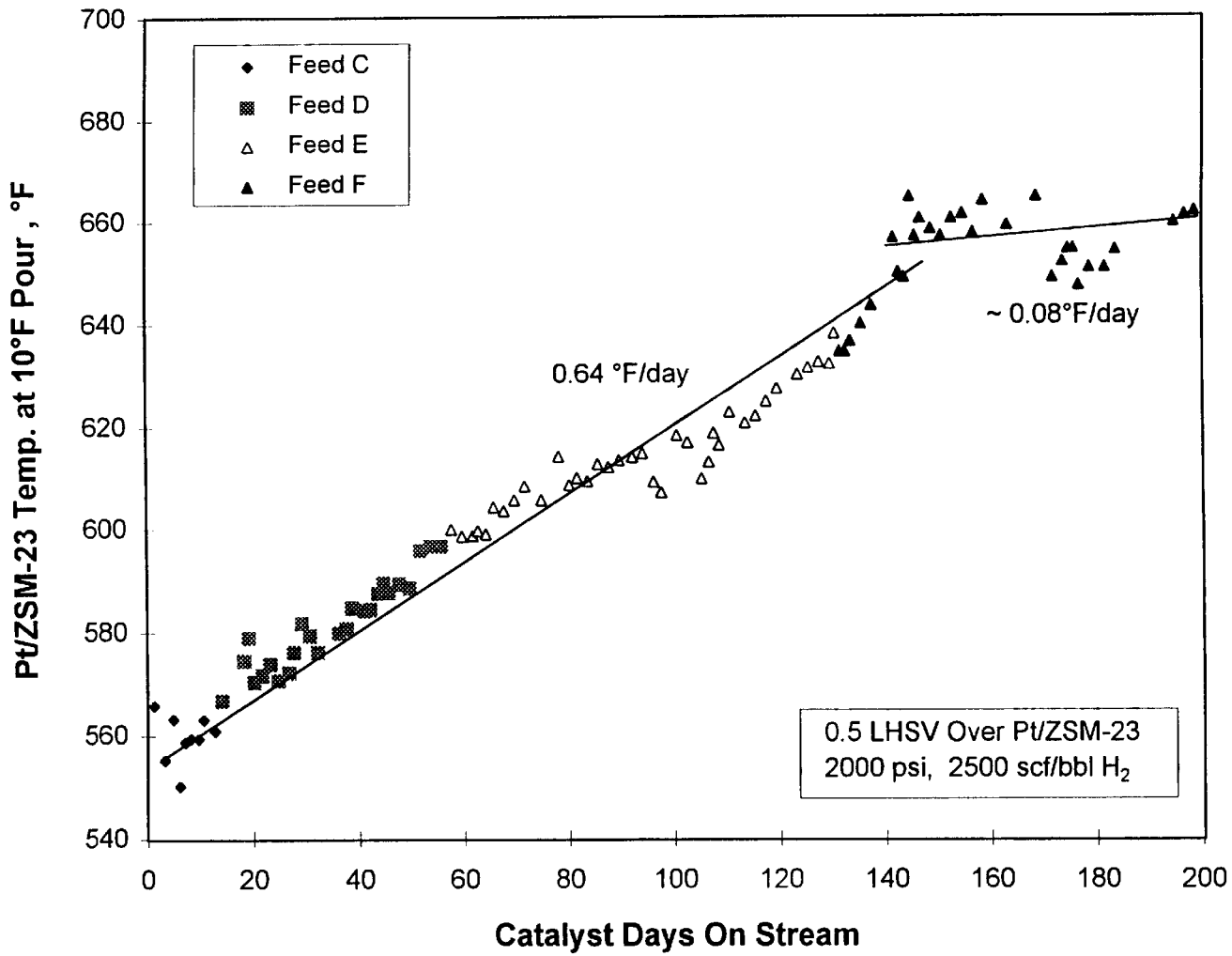
Figure 3: 0.5% Pt/ZSM-23 Catalyst Aging For Dewaxing Hydrocracked Heavy Vacuum Gas Oils Figure 4: HDT / 0.2% Pt/ZSM-23 Catalyst System Aging For Dewaxing Hydrocracked Heavy Vacuum Gas Oils
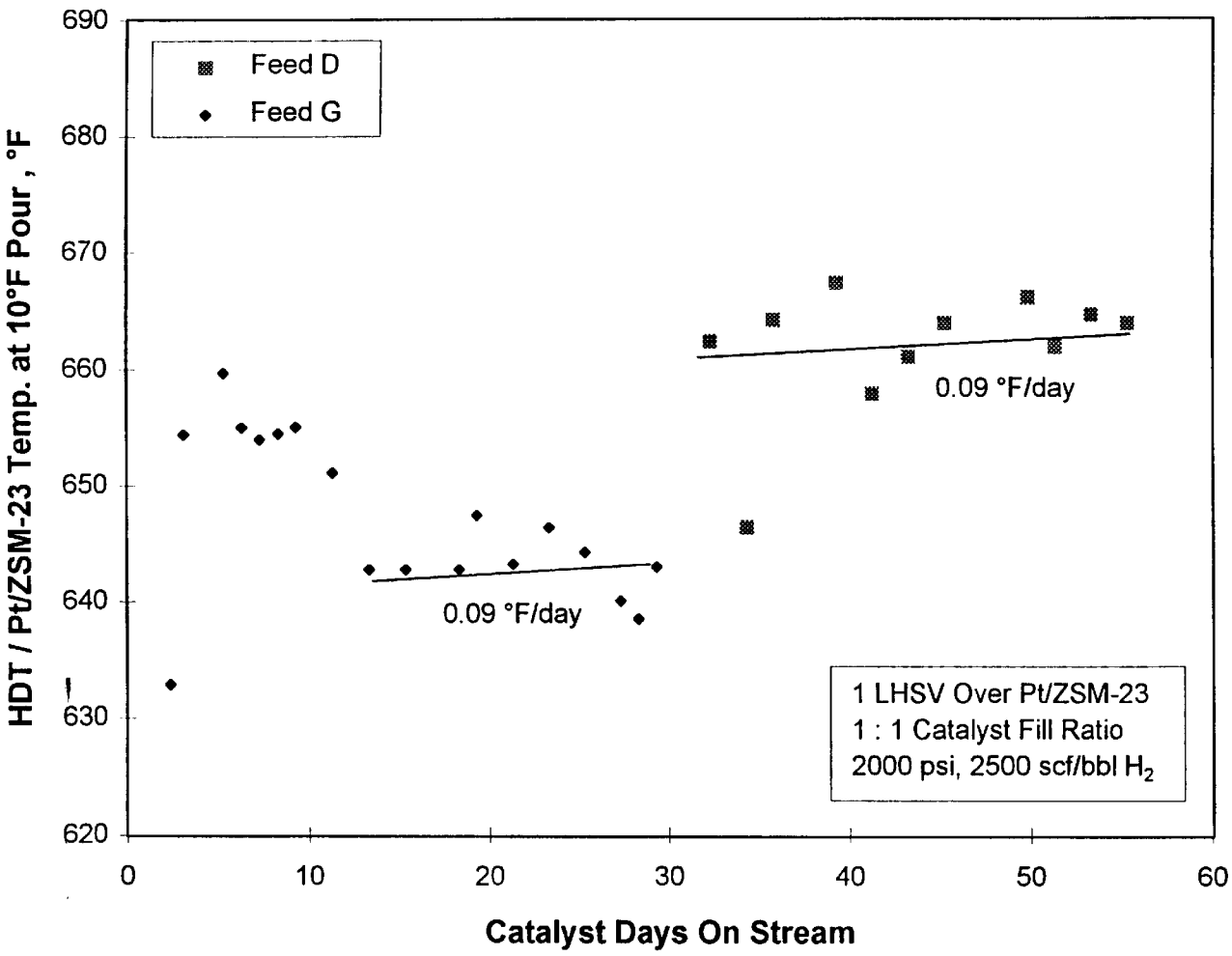

Figure 5: HDT / 0.5% Pt/ZSM-23 Catalyst Aging For Dewaxing Hydrocrackates and a Solvent Raffinate
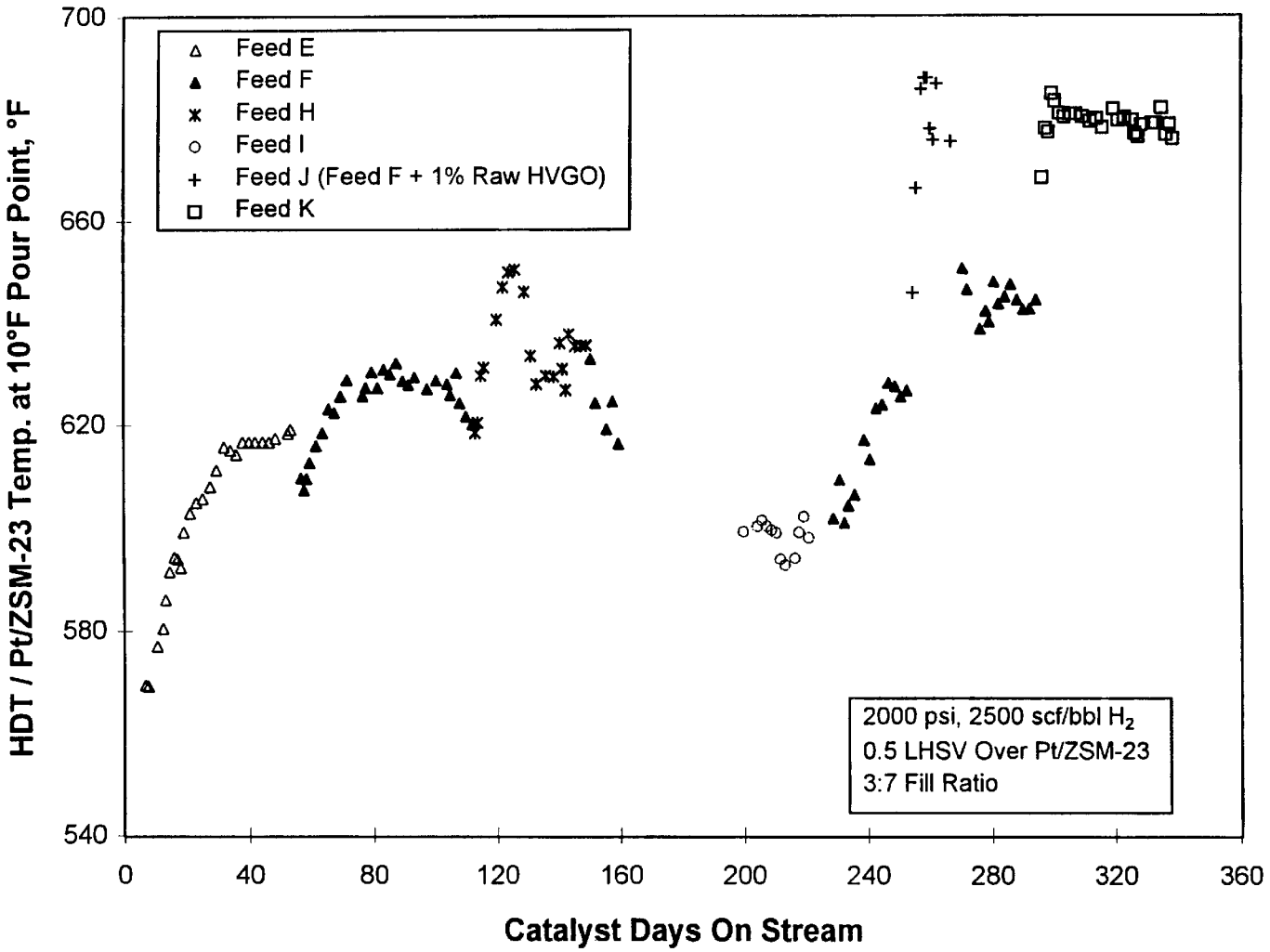

Figure 6: HDT / 0.5% Pt/ZSM-23 Catalyst Aging For Dewaxing a Hydrocracked Heavy Vacuum Gas Oil (Feed F)
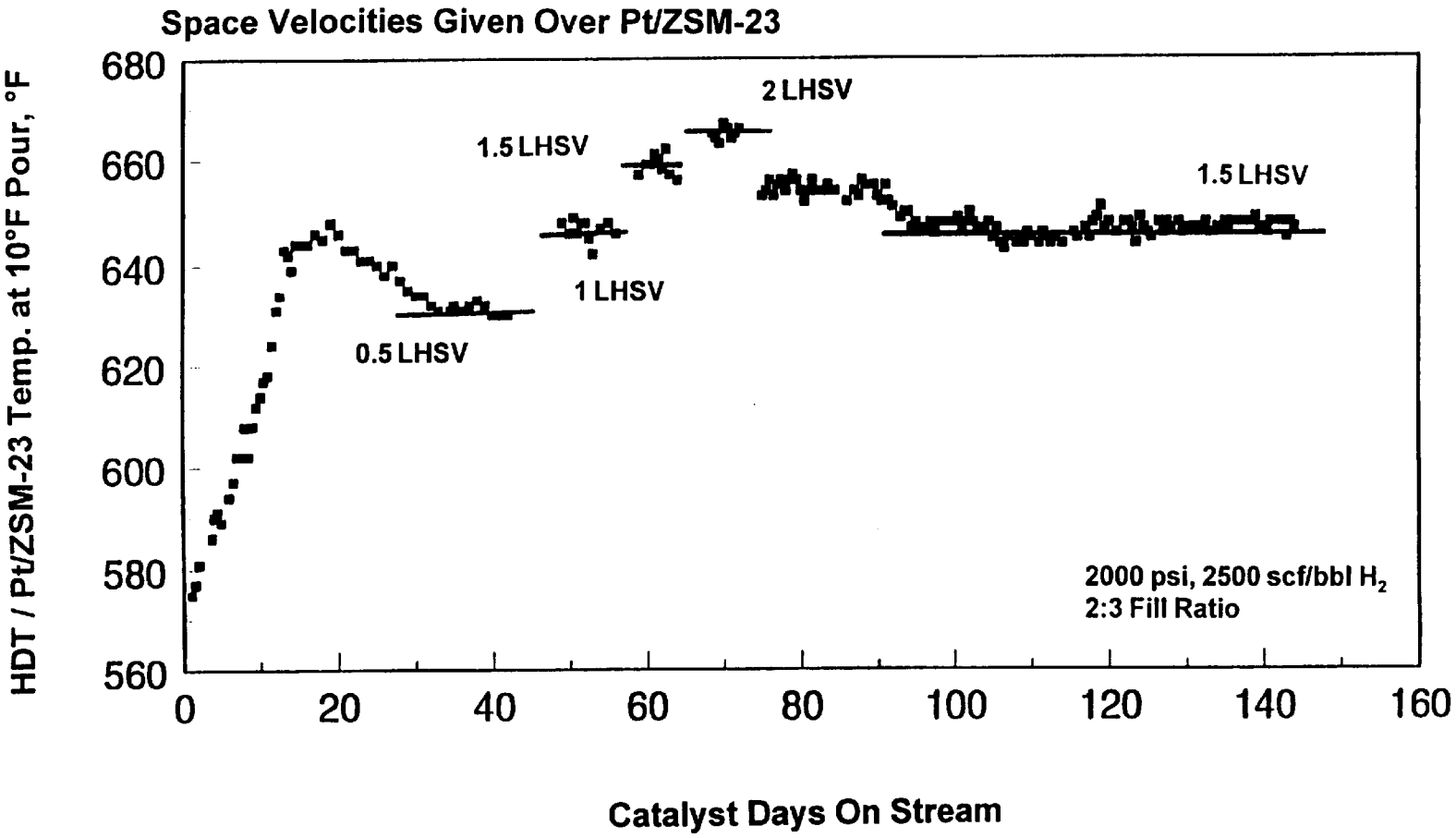

Figure 7: HDT / Pt/ZSM-23 Catalyst System Aging Profile For Dewaxing a Hydrotreated NMP-Refined Raffinate
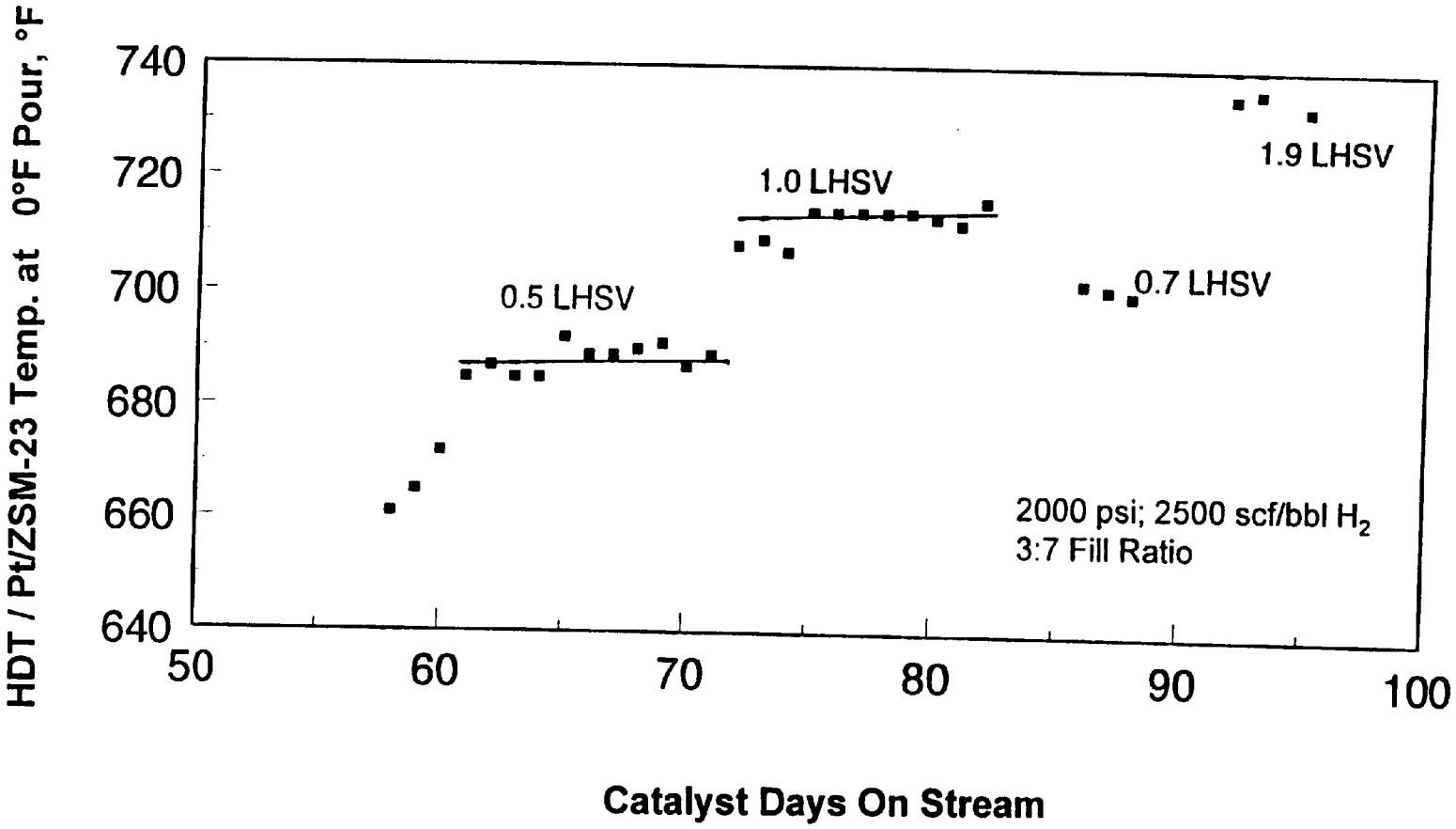

PROCESS FOR HIGHLY SHAPE SELECTIVE DEWAXING WHICH RETARDS CATALYST AGING

CROSS-REFERENCE TO RELATED APPLICATIONS

This application is a continuation-in-part of application Ser. No. 08/742,639 filed Oct. 31, 1996, now abandoned.

FIELD OF THE INVENTION

This invention relates to the highly shape selective catalytic dewaxing of petroleum charge stocks, particularly streams of high wax content which have been hydroprocessed. In this dewaxing process, catalyst aging is retarded, thereby extending cycle length, and catalyst tolerance to sulfur and nitrogen-containing compounds is significantly improved. Minimization of catalyst aging also preserves yield, since high end-of-cycle temperatures often result in non-selective cracking.

BACKGROUND OF THE INVENTION

Dewaxing processes employing constrained intermediate pore molecular sieves as catalysts possess greater selectivity than conventional catalytic dewaxing processes. To improve catalytic activity and to mitigate catalyst aging, these high selectivity catalysts often contain a hydrogenation/dehydrogenation component, frequently a noble metal. Such selectivity benefit is derived from the isomerization capability of the catalyst from its metallic substituent and its highly shape-selective pore structure. ZSM-23, and some other highly selective catalysts used for lube dewaxing, have a unidimensional pore structure. This type of pore structure is particularly susceptible to blockage by coke formation inside the pores and by adsorption of polar species at the pore mouth. Therefore, such catalysts have been used commercially only for dewaxing "clean" feedstocks such as hydrocrackates and severely hydrotreated solvent extracted raffinates. In the development of shape selective dewaxing processes, key issues to be addressed are retardation of aging, preservation of high selectivity over the duration of the catalyst cycle, and maintenance of robustness for dewaxing a variety of feedstocks.

U.S. Pat. No. 4,222,543 (Pelrine) and U.S. Pat. No. 4,814,543 (Chen et al.) were the earliest patents to disclose and claim the use of constrained intermediate pore molecular sieves for lube dewaxing. U.S. Pat. No. 4,283,271 (Garwood et al.) and U.S. Pat. No. 4,283,272 (Garwood et al.) later claimed the use of these catalysts for dewaxing hydrocrackates in energy efficient configurations. Also directed to dewaxing with constrained intermediate pore molecular sieves are U.S. Pat. No. 5,135,638 (Miller), U.S. Pat. No. 5,246,566 (Miller) and U.S. Pat. No. 5,282,958 (Santilli). None of these patents was, however, directed to catalyst durability. Pelrine's examples were directed to start-of-cycle performance with furfural raffinates as feeds. The catalysts used in Pelrine's examples typically age rapidly when exposed to these feeds.

Previous inventions have addressed the problem of catalyst aging and extension of cycle length in dewaxing processes involving intermediate pore zeolites, such as ZSM-5. The techniques disclosed in these inventions are not generally applicable to the catalysts of this invention. U.S. Pat. No. 5,456,820 (Forbus et al.) discloses a process in which a lube boiling range feedstock is catalytically dewaxed in the presence of hydrogen over a catalyst comprising an intermediate pore zeolite in the decationized form. Catalyst cycle length was found to be improved by optimizing the sequencing of various solvent extracted feedstocks.

U.S. Pat. No. 4,892,646 (Venkat et al.) discloses a process for increasing the original cycle length, subsequent cycle lengths and the useful life of a dewaxing catalyst comprising an intermediate pore zeolite (i.e., ZSM-5) and preferably, a noble metal such as Pt. The catalyst is pretreated with a low molecular weight aromatic hydrocarbon at a temperature greater than 800° F., for a time sufficient to deposit between 2 and 30% of coke, by weight, on the catalyst. The pretreatment may be conducted in the presence of hydrogen gas.

U.S. Pat. No. 4,347,121 (Mayer et al., hereinafter Mayer) claimed catalytic dewaxing of hydrocrackates containing less than 10 ppm nitrogen with a hydrofinishing step upstream of the dewaxing catalyst. Mayer is, however, directed to ZSM-5 and ZSM-11. The hydrofinishing step is employed for the purpose of base oil stabilization not to improve the aging characteristics of ZSM-5 or ZSM-11. Commercial experience dewaxing hydrocrackates with ZSM-5 shows negligible aging.

Chen, et al (U.S. Pat. No. 4,749,467), discloses a method for extending dewaxing catalyst cycle length by employing the combination of low space velocity and a high acidity intermediate pore zeolite. The high acid activity and low space velocity reduce the start-of-cycle temperature. Because catalyst deactivation reactions are more temperature sensitive than are dewaxing reactions, low operating temperatures reduce the catalyst aging rate. The same principle has been found to apply to unidimensional constrained intermediate pore molecular sieves.

Dewaxing catalysts comprising intermediate pore molecular sieves containing noble metals have been found to have relatively high aging rates when dewaxing heavy hydrocrackate feeds at a space velocity of 1 LHSV or greater. The catalyst eventually lines out at high temperature, resulting in non-selective cracking and significant yield loss. The aging rate and yield loss with time can be reduced somewhat by operation at a relatively low space velocity. Additionally, noble metal-containing constrained intermediate pore catalysts age very rapidly when exposed to feedstocks having even modest levels of nitrogen and sulfur, such as mildly hydrotreated solvent refined feeds or hydrocrackates produced at low hydrocracker severity.

It has been discovered, however, that the use of a high activity hydrotreating catalyst (a catalyst which can operate effectively at high space velocities and relatively low temperatures is considered a high activity catalyst) upstream of the dewaxing catalyst (preferably in one vessel, creating a synergistic catalyst system) is extremely effective for reducing the dewaxing catalyst aging rate and eventual line out temperature. The synergistic catalyst system also permits operation at significantly higher space velocities than would be possible with the dewaxing catalyst operating alone. The synergistic combination of hydrotreating and dewaxing catalysts offers the potential for longer cycle length while processing difficult feeds with moderate amounts of nitrogen, sulfur and aromatics, such as low conversion hydrocrackates. This invention is also effective with hydrotreated raffinates and some neat raffinates. This is an unexpected improvement, since nitrogen and sulfur are generally known to be effective poisons for catalysts loaded with noble metals.

There are also economic advantages from the invention. It is significantly less expensive to load a dewaxing reactor with a combination of hydrotreating catalyst and noble metal containing dewaxing catalyst than it is to load a reactor with the dewaxing catalyst alone. This also avoids gas separation and clean-up typical of prior art.

The prior art discussed in the background above demonstrates that previous attempts to retard aging and yield loss have been focused on restricting conditions of the dewaxing process to specific parameters, such as temperature or space velocity. Alternately, the dewaxing catalyst itself has been altered by additional steps such as precoking or is formulated to high alpha requirements, both of which can reduce catalyst selectivity. The instant invention retards aging much more effectively than methods previously disclosed. It is also much less expensive and time consuming to implement.

The dewaxing catalysts of this invention are very effective hydrogenation catalysts when acting alone, nearly completely saturating the aromatics in the feed. It is, therefore, unexpected that adding a high activity hydrotreating catalyst ahead of, and preferably in, the same reactor with the dewaxing catalyst results in dramatic minimization of aging. Catalyst line-out time and eventual equilibration temperature are reduced. Furthermore, the upper space velocity limit for stable operation of the dewaxing catalyst is substantially extended. The catalyst combination of the instant invention appears to have a different aging mechanism than the dewaxing catalyst operating alone, permitting higher space velocity operation simultaneously with a lower aging rate.

The synergistic catalyst combination of the instant invention performs well for hydrocracked feeds in addition to permitting the processing of feeds with moderately high levels of nitrogen and sulfur. Such feeds would ordinarily poison either of these catalysts alone causing rapid and uncontrollable aging.

The invention may be summarized as follows:

A process for catalytically dewaxing a lubricant feedstock whereby the aging of the dewaxing catalyst and eventual line-out temperature are minimized. Applicable feedstocks are preferentially hydrocrackates or hydrotreated raffinates but include raffinate products of conventional solvent extraction processes. The feedstock is contacted in the presence of hydrogen with the catalyst system at a space velocity (based on the dewaxing catalyst volume) between 0.2 and 10 and in a temperature range between 450° F. and 800° F. The catalyst system comprises a high activity hydrotreating catalyst operating upstream of a dewaxing catalyst, preferably (although not restricted to operating) in the same reactor vessel. The hydrotreating and dewaxing catalysts each preferably contain one or more noble metals with the dewaxing catalyst also containing a constrained intermediate pore molecular sieve.

DESCRIPTION OF THE DRAWINGS

FIG. 1 provides the aging profile for 0.2% Pt/ZSM-23 catalyst when used alone to dewax a hydrocracked heavy vacuum gas oil (HVGO).

FIG. 2 shows an aging profile at start-of-cycle for a 0.2% Pt/ZSM-23 catalyst used to dewax a hydrocracked HVGO contaminated with 0.25% of raw HVGO.

FIG. 3 illustrates the aging profile for a 0.5% Pt /ZSM-23 dewaxing catalyst using several different heavy hydrocrackate feeds.

FIG. 4 shows the aging profile for a 0.2% Pt/ZSM-23 dewaxing catalyst when used in synergistic combination with a high activity hydrotreating catalyst. Results using two different feeds are illustrated.

FIG. 5 illustrates the aging profile for a 0.5% Pt/ZSM-23 dewaxing catalyst when employed in a catalyst system with a noble metal hydrotreating catalyst, using several different hydrocrackate feeds and a solvent refined raffinate.

FIG. 6 illustrates the aging profile for the catalyst system employing a noble metal hydrotreating catalyst and 0.5% Pt/ZSM-23 operating at several space velocities, using a heavy hydrocrackate feed.

FIG. 7 is an aging profile for the synergistic combination of noble metal hydrotreating catalyst and 0.5% Pt/ZSM-23 when a hydrotreated raffinate is used.

DETAILED DESCRIPTION OF THE INVENTION

Feed

The present process is capable of operating with a wide range of feeds of mineral oil origin to produce a range of lubricant base oils with good performance characteristics. Such characteristics include low pour point, low cloud point, and high Viscosity Index. The quality of the lube base stock and is dewaxing yield are dependent on the quality of the feedstock and its amenability to processing by the catalysts of the instant invention. Feedstocks for this process are derived from the atmospheric residuum fraction of crude oil including vacuum gas oils and vacuum residues, as well as those produced by Fisher Tropsch processing of synthesis gas.

Prior to dewaxing, crude fractions used to make lubricant stocks are generally subjected to one or more refining steps which remove low Viscosity Index components such as heteroatoms, aromatics, and polycyclic naphthenes. This upgrading step can be accomplished by solvent extraction, hydroprocessing, or a combination of the two steps. If the Viscosity Index improvement occurs by a single hydroprocessing step, the upgrading process is typically accompanied by a significant amount of conversion of the feed to products boiling below the initial boiling point of the feed and is termed hydrocracking. Hydroprocessing used in conjunction with solvent extraction will generally not result in significant conversion of feed to light products. Low boiling range conversion hydroprocessing is termed hydrotreating. Hydroprocesses used for Viscosity Index improvement typically operate at hydrogen partial pressures above 1000 psig and remove most of the sulfur and nitrogen-containing species in the material being treated. Because nitrogen and sulfur act as poisons for noble metal-containing catalysts, preferred feedstocks for this invention are those which have been hydroprocessed. However, some solvent refined raffinates are also suitable for dewaxing by the catalysts of the instant invention.

The Viscosity Index of the dewaxed lubricant base oil is directly related to the Viscosity Index of the entrained oil in the waxy feedstock, as determined by solvent dewaxing, and to the wax content of the feedstock. Because the catalytic system of this invention has paraffin isomerization ability, lube base stocks having very high VI can be produced by dewaxing high wax content feedstocks such as slack waxes, foots oils, derivatives of waxy crude vacuum gas oils, and waxes produced by Fischer-Tropsch processing of synthesis gas.

Pretreating of Feed

If hydrocracking is employed as a pretreatment step, an amorphous bifunctional catalyst is preferably used to promote the saturation and subsequent ring opening of the low quality aromatic components in the feed to produce hydrocracked products which are relatively more paraffinic. Hydrocracking is typically carried out at high pressure primarily to minimize catalyst aging and to favor the removal of sulfur and nitrogen-containing species. Consistent with these process objectives, the hydrogen pressure in the hydrocracking stage is at least 800 psig (about 5500 kPa abs.) and usually is in the range of 1000 to 3000 psig (about 6900 to 20700 kPa abs). Normally, hydrogen partial pressures of at least 1500 psig (about 10500 kPa abs.) are preferred. Hydrogen circulation rates of at least about 1000 SCF/BbI (about 180 n.l.l.$^{-1}$), preferably in the range of 2000 to 8000 SCF/Bbl (about 900 to 1800 n.l.l.$^{-1}$) are suitable.

Lube hydrocracker severity is generally set by the Viscosity Index target of the base oil being produced with higher severity (higher feed conversion to light byproducts) being required for higher VI. In some instances, particularly those in which a high shape selective noble metal-containing dewaxing catalyst is used downstream of the hydrocracker, denitrogenation and desulfurization considerations may necessitate hydrocracker operation at higher severity than required to meet the target base oil Viscosity Index. This results in lower base oil yields and can offset the benefits of using a highly shape selective dewaxing catalyst. It is a primary motivation behind the instant invention to develop a catalyst system which is both highly selective for dewaxing but which has high tolerance for feedstock impurities such as nitrogen and sulfur. This enables operation of the hydrocracker to meet only the required base stock VI and maximizes overall base oil yield. A dewaxing catalyst system which is capable of processing feeds with moderate levels of sulfur and nitrogen can also be used to leverage the pressure of the upstream hydroprocessing unit, thus saving capital expense.

Hydrocrackers used primarily to produce high quality fuels in which the high boiling by-product is used for lubes manufacture will often operate at higher severity than lubes-dedicated hydrocrackers. In these cases, conversion is dictated primarily by fuels considerations.

For hydrocrackers dedicated to lube manufacture, the conversion of the feed to products boiling below the lube boiling range, typically to 650° F.– (about 343° C.–) products is generally not more than 50 wt. % of the feed. Conversion to 650° F.– products will exceed 30 wt % only for the poorest quality feeds and for instances where base oil VI targets exceed those of conventional base stocks (95–100 VI).

The conversion may be maintained at the desired level by control of the temperature in the hydrocracking stage which will normally be in the range of 600° to 800° F. (about 315° to 430° C.) and more usually in the range of about 650° to 750° F. (about 345° to 400° C.). Space velocity variations may also be used to control severity although this will be less common in practice in view of mechanical constraints on the system. Generally, the space velocity will be in the range of 0.25 to 2 LHSV hr.$^{-1}$ and usually in the range of 0.5 to 1.5 LHSV.

Significant aromatics saturation occurs in the hydrocracking process although the degree of saturation is limited thermodynamically by the hydrocracking catalyst temperature. High temperatures shift the equilibrium of exothermic reactions such as aromatics saturation in the reverse direction of the desired reaction path. Therefore, hydrocrackates will typically have aromatics contents of 10–20 wt %, generally no lower than 5%, and higher than 30% only for low conversion, low pressure operation.

Hydrocracking catalysts are bifunctional in nature including a metal component for promoting the desired aromatics saturation, denitrogenation, and desulfurization reactions and an acidic component for catalyzing cracking and ring opening reactions. Usually a combination of base metals is used, with one metal from the iron group (Group VIII) in combination with a metal of Group VIB. Thus, the base metal such as nickel or cobalt is used in combination with molybdenum or tungsten. A particularly effective combination for high pressure operation is nickel/tungsten. Noble metal containing catalysts are not typically used for single stage lube hydrocrackers since they have relatively low tolerance to the sulfur and nitrogen levels found in typical or hydrocracker feeds, such as vacuum gas oils. The amounts of the metals present on the catalyst are conventional for a base metal lube hydrocracking catalysts of this type and generally will range from 1 to 10 wt. % of the Group VIII metals and 10 to 30 wt. % of the Group VI metal, based on the total weight of the catalyst. The metals may be incorporated by any suitable method including impregnation onto the porous support after it is formed into particles of the desired size or by addition to a gel of the support materials prior to calcination. Addition to the gel is a preferred technique when relatively high amounts of the metal components are to be added, e.g., above 10 wt. % of the Group VI metal. These techniques are conventional in character and are employed for the production of lube hydrocracking catalysts.

The metal component of the catalyst is generally supported on a porous, amorphous metal oxide support, and alumina or silica-alumina are preferred for this purpose. Other metal oxide components may also be present in the support although their presence is less desirable. Consistent with the requirements of a lube hydrocracking catalyst, the support should have a pore size and distribution which is adequate to permit the relatively bulky components of the high boiling feeds to enter the interior pore structure of the catalyst where the desired hydrocracking reactions occur. To this extent, the catalyst will normally have a minimum pore size of about 50 A, i.e., with no less than about 5% of the pores having a pore size less than 50 A pore size, with the majority of the pores having a pore size in the range of 50–400 A (no more than 5% having a pore size above 400 A), preferably with no more than about 30% having pore sizes in the range of 200–400 A. Preferred catalysts for the first stage have at least 60% of the pores in the 50–200 A range. The properties of some typical lube hydrocracking (LHDC) catalysts suitable for use in the hydrocracking are shown in Table 1.

TABLE 1

LHDC Catalyst Properties

| Form | 1.5 mm. cyl. | 1.5 mm. tri. | 1.5 mm. cyl. |
|---|---|---|---|
| Pore Volume, cc/g, | 0.331 | 0.453 | 0.426 |
| Surface Area, $m^2$/gm | 131 | 170 | 116 |
| Nickel, wt. pct. | 4.8 | 4.6 | 5.6 |
| Tungsten, wt. pct. | 22.3 | 23.8 | 17.25 |
| Fluorine, wt. pct. | — | — | 3.35 |
| $SiO_2/A1_2O_3$ Binder | — | — | 62.3 |
| Real Density, gm/cc | 4.229 | 4.238 | 4.023 |
| Particle Density, gm/cc | 1.744 | 1.451 | 1.483 |
| Packing Density, gm/cc | 1.2 | 0.85 | 0.94 |

If necessary to obtain the desired conversion, the catalyst may be promoted with fluorine, either by incorporating fluorine into the catalyst during its preparation or by operating the hydrocracking in the presence of a fluorine compound which is added to the feed. Alumina-based catalysts are typical of those which require fluorine promotion. Silica-alumina or zeolitic based catalysts have requisite intrinsic acidity and do not generally require fluorine addition. Fluorine containing compounds may be incorporated into the catalyst by impregnation during its preparation with a suitable fluorine compound such as ammonium fluoride ($NH_4F$) or ammonium bifluoride ($NH_4F$ HF) of which the latter is preferred. The amount of fluorine used in catalysts which contain this element is preferably from about 1 to 10 wt. %, based on the total weight of the catalyst, usually from about 2 to 6 wt. %. The fluorine may be incorporated by adding the fluorine compound to a gel of the metal oxide support during the preparation of the catalyst or by impregnation after the particles of the catalyst have been formed by drying or calcining the gel. If the catalyst contains a relatively high amount of fluorine, as well as high amounts of the metals as noted above, it is preferred to incorporate the metals and the fluorine compound into the metal oxide gel prior to drying and calcining the gel to form the finished catalyst particles.

The catalyst activity may also be maintained at the desired level by in situ fluoriding in which a fluorine compound is added to the stream which passes over the catalyst in this stage of the operation. The fluorine compound may be added continuously or intermittently to the feed or, alternatively, an initial activation step may be carried out in which the fluorine compound is passed over the catalyst in the absence of the feed, e.g., in a stream of hydrogen in order to increase the fluorine content of the catalyst prior to initiation of the actual hydrocracking. In situ fluoriding of the catalyst in this way is preferably carried out to induce a fluorine content of about 1 to 10% fluorine prior to operation, after which the fluorine can be reduced to maintenance levels sufficient to maintain the desired activity. Suitable compounds for in situ fluoriding are orthofluorotoluene and difluoroethane.

The metals present on the catalyst are preferably used in their sulfide form and to this purpose pre-sulfiding of the catalyst should be carried out prior to initiation of the hydrocracking. Sulfiding is an established technique and it is typically carried out by contacting the catalyst with a sulfur-containing gas, usually in the presence of hydrogen. The mixture of hydrogen and hydrogen sulfide, carbon disulfide or a mercaptan such as butyl mercaptan is conventional for this purpose. Presulfiding may also be carried out by contacting the catalyst with hydrogen and a sulfur-containing hydrocarbon oil such as a sour kerosene or gas oil.

Hydrocracking is the preferred process route for upgrading base oil Viscosity Index prior to dewaxing for this invention. However, other processes are practiced commercially for this purpose and are suitable for application of the technology described herein. Such processes include solvent extraction by either furfural, n-methyl-2-pyrrolidone (NMP), or phenol, and hydrotreating. The raffinate product of solvent extraction is typically dewaxed by dilution with solvent with subsequent filtration or by catalytic dewaxing. Unidimensional molecular sieves discussed in prior art are not suitable for dewaxing raffinates since the high nitrogen and sulfur levels of these materials results in unacceptably low catalyst life. The instant invention is more robust for dewaxing feeds with moderate levels of nitrogen and sulfur and is suitable for dewaxing raffinates although raffinates having less than 5000 ppmw sulfur and 50 ppmw nitrogen are preferred.

The primary difference between hydrotreating and hydrocracking is in the degree of boiling range conversion which occurs with conversion to 650° F.– products typically being less than 10% of the feed characteristic for hydrotreating. Hydrocracking can act alone as a VI improvement step for treating vacuum gas oils to produce conventional quality lube stocks. Hydrotreating, as defined here, does not provide as significant a boost in Viscosity Index and must be used in conjunction with another VI improvement step, such as solvent extraction, to produce conventional quality base stocks.

Hydrotreating occurs typically over a base metal catalyst similar in composition to lube hydrocracking catalysts although hydrotreating catalysts do hot require an acidic support. Operating pressures and temperatures are similar to those suitable for hydrocracking although while in practice hydrocrackers operate at $H_2$ partial pressures above 1500 psig, hydrotreaters may operate at significantly lower pressures, less than 1000 psig for example. The degree of denitrogenation and desulfurization for hydrotreating may be as high as for hydrocracking but may be much lower because of lower operating pressures. Materials which have been hydrotreated are suitable feedstocks for the instant invention giving acceptable catalyst aging. However, highly shape selective catalysts of prior art do not provide acceptable catalyst life for hydrotreated feedstocks having moderate levels of nitrogen and sulfur.

Dewaxing Step Employing Synergistic Catalyst System

The dewaxing feedstocks following the VI improvement processing step contain quantities of waxy straight chain, n-paraffins, together with higher isoparaffins, naphthenes and aromatics. Because these contribute to unfavorable pour points, it is necessary to remove these waxy components. Dilution with solvents, usually methylethyl ketone, toluene, and methyisobutyl ketone, followed by filtration at low temperatures is the traditional method for dewaxing solvent refined and hydroprocessed lube stocks. To catalytically remove the undesirable waxy components without removing the desirable isoparaffinic components which contribute to high Viscosity Index in the product, dewaxing with a shape-selective dewaxing catalyst is necessary. This catalyst removes the n-paraffins together with the waxy, slightly branched chain paraffins, while leaving the more branched chain iso-paraffins in the process stream. Shape selective dewaxing is more fully explained in U.S. Pat. No. 4,919,788, to which reference is made for a description of this process. Unidimensional constrained intermediate pore molecular sieves have been found to be particularly shape selective and have been found useful for dewaxing very clean feedstocks. These catalysts typically contain a metal component to enhance activity and retard aging and therefore also have the ability to convert wax into lube by isomerization.

The catalytic dewaxing step in this invention is carried out with a catalyst system comprising two catalysts acting in synergy. The initial catalyst is a high activity hydrotreating catalyst. Such a catalyst is capable of operating at relatively high space velocities and low temperatures. Since it is preferred to practice this invention in a single reactor vessel, the hydrotreating catalyst must have sufficient activity at the temperature at which the dewaxing catalyst operates. Therefore hydrotreating catalysts containing noble metals such as platinum or palladium are preferred in this invention since they have good hydrogenation activity if poisoning with heteroatoms can be avoided. Catalysts containing Group VII and Group VIII metals can be used but are less desired generally because they have lower activity than noble metal catalysts. The amount of noble metals present on the catalyst can range from 0.1 % to 5 wt. %, preferably between 0.2 wt. % and 2 wt. %. Noble metals may be used in combination such as platinum and palladium in preferred ratios between 2:1 and 1:5 platinum-to-palladium.

The metals may be incorporated by any suitable convention method.

The metal component of the catalyst is generally supported on a porous, amorphous metal oxide support. A silica-alumina combination with low acid activity is acceptable. Other metal oxide components may also be present in the support although their presence is less desirable. The hydrotreating step employed in this invention differs significantly from hydrotreating used in combination with solvent extraction to improve base stock Viscosity Index. Firstly, the hydrotreating catalyst upstream of the dewaxing catalyst provides no VI boost to the finished lube. Base oil VI is nearly identical for the case where the dewaxing catalyst operates alone or in tandem with the hydrotreating catalyst. Secondly, the effluent from the hydrotreating catalyst passes directly over the dewaxing catalyst without any pressure reduction or light product separation steps. As typically practiced, both hydrocrackers and hydrotreaters do not operate in cascade with a catalytic dewaxer.

The second catalyst is a selective dewaxing catalyst based on a constrained intermediate pore crystalline material, such as a zeolite or a silica alumino-phosphate. A constrained intermediate crystalline material is defined as having no more than one channel of 10-membered oxygen rings with possible intersecting channel having 8-membered rings. ZSM-23 is the preferred molecular sieve for this purpose although other highly shape-selective zeolites such as ZSM-22, ZSM48, ZSM-50 or the synthetic ferrierite ZSM-35 may also be used. Silicoaluminophosphates such as SAPO-11, SAPO-31 and SAPO41 are also suitable for use as the selective dewaxing catalyst.

The synthetic zeolite ZSM-23 is described in U.S. Pat. Nos. 4,076,842 and 4,104,151 to which reference is made for a description of this zeolite, its preparation and properties. The synthetic zeolite designated ZSM-48 is more particularly described by U.S. Pat. Nos. 4,375,573 and 4,397,827, the entire contents of which are incorporated herein by reference. The synthetic zeolite designated ZSM-50 is more particularly described by U.S. Pat. No. 4,640,829.

The intermediate pore-size synthetic crystalline material designated ZSM-35 ("zeolite ZSM-35" or simply "ZSM-35"), is described in U.S. Pat. No. 4,106,245 to which reference is made for a description of this zeolite and its preparation. The synthesis of SAPO-11 is described in U.S. Pat. Nos. 4,943,424 and 4,440,871. The synthesis of SAPO41 is described in U.S. Pat. No. 4,440,871.

Ferrierite is a naturally-occurring mineral, described in the literature, see, e.g., D. W. Breck, ZEOLITE MOLECULAR SIEVES, John Wiley and Sons (1974), pages 125–127, 146, 219 and 625, to which reference is made for a description of this zeolite.

The dewaxing catalysts used in this invention include a metal hydrogenation-dehydrogenation component which is preferably a noble metal although not restricted to a noble metal or a combination of noble metals. Although it may not be strictly necessary to promote the selective cracking reactions, the presence of this component has been found to be desirable to promote certain isomerization reactions and to enhance catalytic activity. The presence of the noble metal component leads to product improvement, especially VI, and stability. Aging of the shape-selective dewaxing catalyst is significantly retarded in the instant invention by synergistic combination with the upstream hydrotreating catalyst. The shape-selective, catalytic dewaxing is normally carried out in the presence of hydrogen under pressure. The metal is preferably platinum or palladium or a combination of platinum and palladium. The amount of the metal component is typically 0.1 to 10 percent by weight. Matrix materials and binders may be employed as necessary.

Shape-selective dewaxing using the highly constrained, highly shape-selective catalyst with hydrotreating catalysts upstream in a synergistic system may be carried out in the same general manner as other catalytic dewaxing processes. Both catalysts may be in the same fixed bed reactor or the hydrotreating catalyst may be upstream in a separate bed. A single reactor vessel is preferred. Conditions will therefore be of elevated temperature and pressure with hydrogen, typically at temperatures from 250° to 500° C. (about 580° to 930° F.), more usually 300° to 450° C. (about 570° to 840° F.) and in most cases not higher than about 370° C. (about 700° F.). Pressures extend up to 3000 psi, and more usually up to 2500 psi. Space velocities extend from 0.1 to 10 $hr^{-1}$ (LHSV), over the synergistic catalyst system more usually 0.2 to 3 $hr^{-1}$. Operation at a higher space velocity than can be achieved with the dewaxing catalyst operating alone with acceptable aging, yet with a relatively low aging rate at equilibrium, is a critical feature of the instant invention. Hydrogen circulation rates range from 100 to 1000 $n.l.l.^{-1}$, and more usually 250 to 600 $n.l.l.^{-1}$.

Reference is made to U.S. Pat. No. 4,919,788 for a more extended discussion of shape-selective catalytic dewaxing. As indicated previously, hydrogen may be used as an interbed quench in order to provide optimal temperature control in the reactor.

The degree of conversion to lower boiling species in the dewaxing stage will vary according to the extent of dewaxing desired at this point, i.e., on the difference between the target pour point and the pour point of the feed. It must be noted that the catalyst system of the instant invention is employed primarily to enhance the cycle length of the shape-selective catalyst. Product characteristics will be similar to those found in other shape-selective dewaxing processes. The degree of conversion also depends upon the selectivity of the shape-selective catalyst which is used. At lower product pour points, and with relatively less selective dewaxing catalysts, higher conversions and correspondingly higher hydrogen consumption will be encountered. In general terms conversion to products boiling outside the lube range, e.g., 315° C.–, more typically 343° C.–, will be at least 5 wt. %, and in most cases at least 10 wt. %, with conversions of up to about 40 wt. % being necessary only to achieve the lowest pour points or to process high wax content feeds with catalysts of the required selectivity. Boiling range conversion on a 650° F.+ (343° C.+) basis will usually be in the range of 10–25wt. %.

After the pour point of the oil has been reduced to the desired value by selective dewaxing, the dewaxed oil may be subjected to treatments such as mild hydrotreating or hydrofinishing, in order to remove color bodies and produce a lube product of the desired characteristics. Fractionation may be employed to remove light ends and to meet volatility specifications.

EXAMPLES

Aging experiments were conducted with hydrocrackates (primarily those derived from heavy vacuum gas oils), a light neutral raffinate, a hydrotreated raffinate, and hydrocracked stocks contaminated with vacuum gas oil. The experiments show benefits for a pre-hydrotreating step on dewaxing catalyst and eventual lineout temperature, and ability to operate stably at high space velocities. Properties of the aging feedstocks used in these experiments are given by Table 2.

Feedstocks A, C, and E through M were derived by hydrocracking a heavy vacuum gas oil (HVGO) from a mix of Persian Gulf crudes. These materials differ from each other by the hydrocracking severity used to produce them. High conversion hydrocracking increases lube VI and reduces sulfur and nitrogen levels. Feedstock D was produced in a similar manner by hydrocracking an Arab Light heavy vacuum gas oil and Feed I represents a hydrocracked light vacuum gas oil.

To test the robustness of the synergistic catalyst system, Feeds B and J were produced by contaminating hydrocracked Feeds A and F with 0.25 and 1% raw HVGO respectively. Feedstock J contained the highest level of nitrogen of the feeds processed here at 39 ppm. Feed K represents a light vacuum gas oil commercially extracted with furfural to produce a nominal 100 VI solvent dewaxed base oil. It contained the highest sulfur content (2300 ppm) of any of the feeds tested.

Feed L represents an NMP-extracted light neutral which was subsequently hydrotreated at mild conditions (<5% 650° F.+ conversion, 1000 psig $H_2$). It has sulfur and nitrogen contents lower than the furfural raffinate (Feed K) but substantially higher than the hydrocrackates.

TABLE 2

Dewaxer Feedstock Properties

| Feed Description | A HDC HVGO | B Feed A+ ~25% Raw HVGO | C HDC HVGO | D HDC Arab Light HVGO | E HDC HVGO | F HDC HVGO | G HDC HVGO | H HDC HVGO | I HDC LVGO | J Feed F 1% Raw HVGO | K 100 SUS Fufural Raffinate | L HDT 150 SUS Raffinate |
|---|---|---|---|---|---|---|---|---|---|---|---|---|
| API Gravity | 29.3 | 30.4 | 31.6 | 29.6 | 30.6 | 28.4 | 29.8 | 27.6 | 33.7 | 28.4 | 32.8 | 29.2 |
| Kinematic Viscosity at 100° C., cSt | 9.6 | 9.1 | 8.7 | — | 8.0 | 9.2 | 10.6 | 12.2 | 4.9 | — | 4.2 | |
| Sulfur, ppm | 24 | 110 | 7 | 26 | 14 | 20 | 11 | 56 | 9 | 470 | 2300 | 1600 |
| Nitrogen, ppm | <0.5 | 4.2 | <0.5 | <0.5 | <0.5 | 2.4 | <0.5 | 6.3 | <1 | 39 | 19 | 14 |
| Aromatics by Mass Spec, % | 14 | — | — | 15 | 14 | — | 6 | — | 5 | — | — | 33 |
| Simulated Distillation, °F. | | | | | | | | | | | | |
| IBP | 686 | 503 | 667 | 738 | 609 | 527 | 665 | 413 | 684 | 631 | 616 | 475 |
| 5% Off | 753 | 747 | 750 | 804 | 681 | 698 | 712 | 678 | 714 | 714 | 673 | 743 |
| 10% | 784 | 780 | 781 | 834 | 723 | 745 | 748 | 728 | 731 | 756 | 691 | 181 |
| 30% | 869 | 865 | 865 | 898 | 838 | 857 | 856 | 851 | 777 | 863 | 733 | 843 |
| 50% | 927 | 924 | 922 | 937 | 915 | 924 | 917 | 923 | 809 | 927 | 771 | 882 |
| 70% | 977 | 974 | 971 | 967 | 972 | 974 | 974 | 976 | 844 | 977 | 813 | 916 |
| 90% | 1038 | 1036 | 1032 | 1004 | 1031 | 1031 | 1086 | 1034 | 891 | 1034 | 877 | 958 |
| FBP | 1138 | 1138 | 1108 | 1074 | 1111 | 1115 | 1278 | 1119 | 958 | 1110 | 957 | 1029 |
| Oil Content at 10° F. Pour By Solvent Dewaxing, wt % | 18 | 17 | 19 | 14 | 18 | 16 | 12 | 14 | 17 | 18 | 19 | 20 |
| Solvent Dewaxed Lube VI at 10° F. Pour | 98 | 98 | 107 | 97 | 103 | 94 | 103 | 86 | 108 | — | 102 | — |

Example 1

The first two experiments were conducted with a 0.2% Pt/ZSM-23 which was prepared by platinum addition by ion exchange to an alumina-bound ZSM-23. In both experiments, the liquid flow rate was held primarily at 1 LHSV over the Pt/ZSM-23, hydrogen partial pressure was primarily 2000 psi, and $H_2$ flow rate was held at 2500 scf/bbl.

The ZSM-23 catalyst in the first experiment was run for 112 days without a pre-hydrotreating step. Feed A (Table 2) was used throughout the run. Because Feed A had a low level of sulfur and nitrogen relative to many of the other feeds evaluated, catalyst aging on this feedstock should be optimistic when compared to other feedstocks. Despite the relatively low level of impurities in the feed during the first 30 days on stream, the catalyst aged at 2.6° F./day before reaching a period of slower aging (0.28° F./day) at 1 LHSV lasting until the end of the run (see FIG. 1). From 60 to 110 days on stream, the liquid flow rate was held primarily at 0.5 LHSV with periodic activity checks at 1 LHSV. Therefore, the 0.28° F./day aging rate observed for this period is likely optimistic when compared to continuous operation at 1 LHSV. When operating at 0.5 LHSV, catalyst aging was reduced to an acceptable level of 0.03° F./day but the operating temperature required to meet a product pour point of 10° F. was fairly high at approximately 670° F. (vs. start-of-cycle at less than 600° F.) While the catalyst showed a 3% yield benefit over solvent dewaxing at start-of-cycle, it gave a 4–5% debit versus solvent dewaxing during the period of slow aging reflecting non-selective cracking at the high catalyst temperatures (Table 3).

The same fresh Pt/ZSM-23 catalyst was used to dewax the same heavy hydrocrackate contaminated with approximately 0.25% raw HVGO (Feed B) to test catalyst robustness for treating feeds with moderate levels of nitrogen and sulfur. Catalyst aging at 1 LHSV was initially very high at 4.5° F./day with start-of-cycle temperature requirement to reach a 10° F. pour product higher than 670° F. Reducing space velocity to 0.6 $hr^{-1}$ after 7 days on stream only slightly reduced the temperature requirement to reach target pour point and throughout the early part of the catalyst cycle, lube yield was 4% lower than for solvent dewaxing (Table 3). Clearly the Pt/ZSM-23 had limited ability to process a feedstock having even a moderately lower nitrogen content (4 ppm).

Example 2

A 200 day aging run was conducted with a 0.5% Pt/ZSM-23 with several hydrocrackated HVGOs (FIG. 3). Platinum was added by ion exchange. The additional platinum improves the hydrotreating ability of the catalyst of Example 2 versus the 0.2% Pt/ZSM-23 of Example 1. The aging run was conducted at a space velocity of 0.5 $hr^{-1}$ over Pt/ZSM-23, a hydrogen partial pressure of 2000 psig, and with a hydrogen circulation rate of 2500 scf/bbl.

The catalyst aged at approximately 0.64° F./day for the first 140 days on stream before reaching a period of lower aging (0.08° F./day). The lower initial aging rate and longer period to reach a "lined-out" state is consistent with Chen's observation (U.S. Pat. No. 4,749,467) and the catalyst formulation is clearly more selective than that used in Example 1 (see Table 3). However, the lineout temperature still exceeded 660° F. and, in that respect, showed no improvement over the catalyst of Example 1. From the data in FIGS. 1 and 3, it can be determined that both catalysts would have approximately the same life when operating at the same space velocity.

Pt/ZSM-23 has significant activity for saturating aromatics as shown by Table 4. A good relative indicator of the aromatics content of a base oil, widely used within the industry, is ultraviolet absorbtivity at 226 nm. Table 2 shows that 226 nm absorbtivity is reduced by at least 85% and in some cases over 95% by dewaxing over Pt/ZSM-23.

pared to 4–5% yield debit vs. solvent dewaxing for Pt/ZSM-23 operating alone).

Analysis of the feedstock and liquid product UV absorbtivities showed a greater than 90% reduction in the 226 nm absorbtivity over the high activity noble metal hydrotreating catalyst (Table 5). By comparing the data of Tables 4 and 5, it can be concluded that the hydrotreating catalyst had a slightly better capacity for aromatics reduction than did the Pt/ZSM-23 dewaxing catalyst. Feedstock sulfur was reduced by 80% over the hydrotreating catalyst while the nitrogen species were not measurably converted.

TABLE 3

Summary of Equilibrated Catalyst Seletivities

| Dewaxing Experiment | Feedsock | LSHV, hr−1 Over Pt/ZSM-23 | Overall LHSV, $hr^{-1}$ | Approximate Lined Out Operating Temperature, °F. | Advantage Over Solvent Yield, wt. % | VI |
|---|---|---|---|---|---|---|
| 0.2% Pt/ZSM-23 Alone | Feed A | 1.0 | 1.0 | 710 | −5 | 2 |
| (Figure 1) | | 0.5 | 0.5 | 670 | −4 | 2 |
| 0.2% Pt/ZSM-23 Alone (Figure 2) | Feed B | 0.5; 1.0 | 0.5; 1.0 | Not Equilibrated | −4 | 2 |
| 0.5% Pt/ZSM-23 Alone (Figure 3) | Feeds C–F | 0.5 | 0.5 | 660 | 6 | 7 |
| 0.2% Pt/ZSM-23 With Pre-HDT Bed | Feeds D, G | 1.0 | 0.5 | 640–665 | 1 | |
| (Figure 4) | | | | | 3 | |
| 0.5% Pt/ZSM-23 With | Feeds E, F | 0.5 | 0.35 | 615–635 | 7 | 8 |
| Pre-HDT Bed | Feed H | | | 635 | 4 | 9 |
| (Figure 5) | Feed 1 | | | 595 | 4 | 5 |
| | Feed J | | | 675 | 0 | 8 |
| | Feed K | | | 680 | −5 | 3 |

Example 3

The same fresh ZSM-23 catalyst used in the first experiment was used to dewax hydrocrackate Feeds D and F with an upstream hydrotreating bed. The fill ratio of the hydrotreating catalyst to dewaxing catalyst was 1. The hydrotreating catalyst, a Pt-Pd/$SiO_2Al_2O_3$, having a Pt-Pd ratio of 1:3.3 was maintained at 600° F. for the 58 day duration of the study. The aging run conducted at a hydrogen partial pressure of 2000 psi and feed rate of 2500 scf/bbl. Liquid was charged at a liquid hourly space velocity of 1 $hr^{-1}$ over each catalyst (0.5 $hr^{-1}$ LHSV overall). FIG. 4 shows that the dewaxing catalyst reached a near equilibrated state in only 10 days and for the two feedstocks evaluated, aged at less than 0.1° F. per day. Catalyst lineout occurred at a temperature significantly lower than for the Pt/ZSM-23 operating alone (FIG. 1) when the systems are compared at constant space velocity over the dewaxing catalyst. But even more unexpected is that the lineout temperature of 640° F. to 665° F. compares favorably with Pt/ZSM-23 operating alone at the same space velocity over the entire reaction system. In other words, for a fixed reactor volume, replacing half of the catalyst volume with a high activity hydrotreating catalyst results in the same eventual lineout temperature as if the reactor was completely loaded with dewaxing catalyst but with the advantage of a far shorter lineout period. An additional advantage is that the prehydrotreating step appears to benefit dewaxing selectivity for equilibrated systems (1% yield advantage vs. solvent dewaxing com-

Example 4

A 330 day aging experiment was conducted with the 0.5% Pt/ZSM-23 catalyst of Example 2 and the hydrotreating catalyst of Example 3 loaded upstream of the dewaxing catalyst in a 3:7 fill ratio. The hydrotreating catalyst was maintained at the same temperature as the Pt/ZSM-23 catalyst, consistent with preferred operation of a single reactor vessel. Neither catalyst was presulfided. Both catalysts were reduced in $H_2$ at 500° F. prior to introducing liquid feed. Liquid flow rate wax maintained at 0.5 LHSV over the dewaxing catalyst. Several feedstocks were dewaxed by this catalyst system including hydrocrackates, hydrotreated raffinates, and a raw raffinate. For the bulk of the experiments, hydrogen partial pressure was maintained at 2000 psig and hydrogen flow was 2500 scf/bbl. An aging profile for the entire run is given by FIG. 5.

For the first 120 days on stream, the catalyst system processed feedstocks which were also used in the 0.5% Pt/ZSM-23 aging run of Example 2. While the dewaxing catalyst operating alone required 140 days to reach a pseudo-equilbrated state of operation at 660° F., the HDT/Pt/ZSM-23 catalyst system lined out in only 40 days at temperatures of 620–630° F. for the two feedstocks evaluated. In addition to the reduced line out period and lower equilibrated temperature, the HDT/Pt/ZSM-23 catalyst system showed a 1 VI and a 1% yield benefit over the Pt/ZSM-23 operating alone (Table 3). If the results of Examples 2 and 4 are compared at equivalent space velocity over the entire reaction system by adjusting the results of Example 2 to a 0.35 $hr^{-1}$ LHSV, the HDT/Pt/ZSM-23 system still offers a 10–20° F. advantage over Pt/ZSM-23 operating alone in the eventual line out temperature. Assuming an equilibrated aging rate of 0.1° F./day, this activity benefit translates into an additional half year of catalyst life.

At approximately 120 days on stream, a low conversion heavy hydrocrackate having a nitrogen content of 6.3 ppm nitrogen (Feed H) was dewaxed and after an initial equilibration period, the catalyst system lined out at 635° F. Lube yield and Viscosity Index showed significant advantages for this catalytic dewaxing process against solvent dewaxing (Tabled 3). Later in the aging run, a hydrocrackate contaminated with 1% raw HVGO (Feed J) and containing 470 ppm sulfur and 39 ppm N was dewaxed for approximately 20 days. After an equilibration period, the catalyst system lined out at 675° F. and provided lube yield equivalent to solvent dewaxing and Viscosity Index significantly higher. These results demonstrate the robustness of the synergistic catalyst in comparison to Example 2 in which Pt/ZSM-23 operating alone showed poor activity and selectivity when dewaxing a feedstock containing much lower levels of impurities.

At approximately 200 days on stream, a light hydrocrackate (Feed 1) was dewaxed with negligible aging and high selectivity relative to solvent dewaxing showing that the aging and selectivity advantages of the synergistic catalyst system are not restricted to heavy feedstocks. Also a light neutral furfural raffinate (Feed K) having 2300 ppm sulfur and 16 ppm nitrogen was dewaxed for over one month without measurable aging again demonstrating the robustness of the catalyst system for processing feedstocks containing even moderately high levels of impurities.

The experiment illustrated by FIG. 5 demonstrated that the hydrotreating catalyst need only to fill a fairly small fraction of the dewaxing reactor for the invention to have advantages over loading the reactor with dewaxing catalyst alone. The catalyst system employing hydrotreating catalyst followed by Pt/ZSM-23 (1:2 fill ratio) lined out after only 30 days and showed negligible aging thereafter. This catalyst system lined out at 635° F. while running Feed F; Pt/ZSM-23 operating alone lined out at 660° F. (FIG. 3). Assuming an apparent activation energy of 45 kcal/mol for dewaxing consistent with ZSM-23 dewaxing data from variable flow rate experiments, it is expected that Pt/ZSM-23 operating alone processing Feed F would line out at 650° F. at 0.33 LHSV. Thus, at equivalent overall space velocity, the HDT/ZSM-23 approach offers a 15° F. activity advantage over ZSM-23 operating alone. FIG. 5 also demonstrates the robustness of the HDT/ZSM-23 catalyst system for processing higher nitrogen containing feedstocks. Little activity debit, rapid equilibration, and insignificant aging were observed when the combination catalyst system was used to dewax a feed containing over 6 ppm nitrogen (Feed G, Table 1). This improvement is doubly unexpected because the noble metal hydrotreating catalyst gives only a modest conversion of nitrogen and sulfur in the feed, both of which are well known to be effective poisons for noble metal-containing dual functional catalysts.

Example 5

A subsequent experiment was conducted (see FIG. 6) using the same fresh hydrotreating catalyst as in Example 3 and 4 and another 0.5% Pt/ZSM-23 loaded in a 2:3 fill ratio by volume. A hydrocrackate having similar properties to Feed F in Table 2 was dewaxed at various space velocities for a period of 140 days. The overall system was operated at rates up to 2 LHSV over the ZSM-23, well in excess of previous data. Even at these high feed rates, there were no appreciable signs of aging after a 20 day line out period at catalyst start up. Throughout the run, a substantial advantage over solvent dewaxing for both lube yield and VI was obtained independent of space velocity.

Example 6

Fresh hydrotreating catalyst and Pt/ZSM-23 catalyst, both as in Example 5, were loaded in a 3:7 fill ratio and used to dewax a hydrocracked heavy vacuum gas oil (Feed F of Table 2). To determine the performance of the invention for lower activity pre-hydrotreating, the hydrotreating catalyst was presulfided in a mixture of 98% $H_2$/2% $H_2S$ up to a temperature of 700° F. before the introduction of liquid feed. As shown by Table 5, the effectiveness of the hydrotreating catalyst was significantly diminished as the 226 nm reduction over the HDT catalyst was only 61%. However, the catalyst system showed a similar period of equilibriation to the unpoisoned system of Example 4 of approximately 40 days. The catalyst system equilibrated at a temperature of 638° F. which represents a 22° F. advantage, at constant space velocity over the dewaxing catalyst, over the case where the dewaxing catalyst was operated without the benefit of the upstream hydrotreating catalyst (Example 2). After processing the hydrocracked HVGO for 55 days, the catalyst system was used to dewax a mildly hydrotreated NMP-extracted raffinate (Feed L) over a 90 day period at various space velocities.

Feed L had sulfur and nitrogen levels comparable to the furfural raffinate dewaxed in Example 5 (Feed K). As FIG. 7 shows, the catalyst system performed with stability at space velocities up to 1.9 $hr^{-1}$ over the Pt/ZSM-23 thus demonstrating that the advantage of the synergistic catalyst system for high space velocity operation extends from hydrocrackates to feeds with even moderately high levels of sulfur and nitrogen impurities.

Example 7

ZSM-48 was prepared according to U.S. Pat. No. 5,075,269 and was ion exchanged to contain a platinum loading of 0.5 wt %. The aging behavior of the Pt/ZSM48 was evaluated for dewaxing a heavy hydrocrackate (Feed M) in two separate experiments. In the first experiment, the Pt/ZSM48 was used alone to dewax the feed while in the second experiment, the hydrotreating catalyst of Example 3 was loaded upstream of the Pt/ZSM-48 in a 3:7 fill ratio. In both experimental runs, the catalysts were reduced in $H_2$ at 500° F. before liquid feed introduction. The hydrotreating catalyst was maintained at the same temperature as the dewaxing catalyst. Consistent with the data of Table 5, the hydrotreating catalyst of the second experiemntal run was found to reduce the 226 nm absorbtivity of the liquid by 90%.

In both experimental runs, the dewaxing catalyst lined out in a period of 30 to 40 days. However, the synergistic hyudrotreating/dewaxing catalyst system exhibited an activity advantage over the dewaxing catalyst operating alone of 15° F. at constant LHSV over the dewaxing catalyst and 6° F., by interpolation, when the comparison is made at constant overall space velocity (see Table 6).

Example 8

The hydrotreating catalyst of Example 3 was tested for benzene hydrogenation activity (BHA). Tests were performed at 100° C., atmospheric pressure (1 atm). Partial pressure benzene=43 torr. Partial pressure hydrogen=717 torr. There is a $H_2$/benzene molar ratio of 17:1. Space velocity is WHSV=5 $hr^{-1}$. The BHA rate constant is 0.024 moles benzene per gram catalyst per hour at 100° C.

We claim:

1. A process for catalytically dewaxing a hydrocarbon feed having less than 300 ppm N in the presence of hydrogen employing a synergistic catalyst system comprising the following:

(a) a high activity hydrotreating catalyst which comprises at least one metal supported on an inorganic base, which is effective for reducing, when operating at the same conditions as the subsequent dewaxing catalyst, the aromatics content of the waxy feed, as measured by UV absorbtivity at 226 nm, by at least 60%;

(b) a dewaxing catalyst which comprises constrained intermediate pore molecular sieve having at most one pore channel of 10-membered oxygen rings with any intersecting channels having 8-membered oxygen rings and further comprising a noble metal wherein the hydrotreating catalyst precedes the dewaxing catalyst and the reaction mixture passes directly from the hydrotreating catalyst to the dewaxing catalyst without light byproduct separation between the two catalysts.

2. The hydrotreating catalyst of claim 1 wherein said hydrotreating catalyst possesses a benzene hydrogenation activity which is greater than 0.0024 moles benzene per gram catalyst per hour at 100° C.

3. The process of claim 1, wherein the feedstock contacts the catalyst system in a single bed having two catalyst sections within a single vessel.

4. The process of claim 1, wherein the catalyst system comprises hydrotreating catalyst and dewaxing catalyst in a ratio between 3:1 and 1:10.

5. The process of claim 1, wherein at least one supported metal of the hydrotreating catalyst is a noble metal.

6. The process of claim 5, wherein the hydrotreating catalyst is loaded with both Pt and Pd. in a ratio of between 2:1 and 1:5 Pt:Pd.

7. The process of claim 1 wherein the amount of noble metal present on the dewaxing catalyst is from 0.1 to 5 wt. %.

8. The process of claim 7, wherein the dewaxing catalyst is selected from the group consisting of ZSM-22, ZSM-23, ZSM-35, ZSM48, ZSM-50, SAPO-11, SAPO-31, SAPO-41 and combinations thereof.

9. The process of claim 1 wherein the feedstock to the catalytic dewaxer represents a vacuum gas oil or other petroleum fraction derived from atmospheric residue which has been subjected to a hydrocracking step in which the conversion of feed to products boiling below 650° F. exceeds 10 wt %.

10. The process of claim 1, wherein the hydrocarbon feed is selected from the group consisting of hydrocrackates, solvent extracted raffinates, and hydrotreated raffinates.

11. The process of claim 1, in which the hydrotreating catalyst of step (a) is upstream of the dewaxing catalyst of step (b), in a separate bed.

12. The process of claim 1 wherein said hydrocarbon feed has less than about 50 ppm N.

13. The process of claim 1 wherein said hydrocarbon feed has no greater than 39 ppm N.

14. The process of claim 1 wherein said hydrocarbon feed has no greater than 2300 ppm S.

15. The process of claim 1 wherein the dewaxing catalyst is ZSM-23.

* * * * *